US005233899A

United States Patent [19]

Nakagome

[11] Patent Number: 5,233,899

[45] Date of Patent: Aug. 10, 1993

[54] UNIVERSAL KEYBOARD FOR HAND

[76] Inventor: Yoshifumi Nakagome, Haim Shirogane 301, Shirogame 5-17-9, Mimatoku, Tokyo, Japan

[21] Appl. No.: 837,672

[22] Filed: Feb. 14, 1992

Related U.S. Application Data

[63] Continuation of Ser. No. 629,578, Dec. 18, 1990, abandoned.

[30] Foreign Application Priority Data

Dec. 28, 1989 [JP] Japan ..... 1-338521

[51] Int. Cl.[5] ..... G10C 3/12

[52] U.S. Cl. ..... 84/423 R; 84/427

[58] Field of Search ..... 84/423 R, 423 A, 423 B, 84/424, 427, 428, 433, 451

[56] References Cited

U.S. PATENT DOCUMENTS

| | | | |
|---|---|---|---|
| 197,648 | 11/1877 | McChesney | 84/427 |
| 3,392,620 | 7/1968 | Thompson | 84/425 |
| 3,433,881 | 3/1969 | Cotten | 84/424 X |
| 3,468,209 | 9/1969 | Barreto | 84/423 R |
| 4,444,083 | 4/1984 | Apel et al. | 84/423 R |
| 4,658,696 | 4/1987 | Clancy | 84/444 |
| 4,782,734 | 11/1988 | Rose | 84/423 R |

*Primary Examiner*—Michael L. Gellner
*Assistant Examiner*—Howard B. Blankenship
*Attorney, Agent, or Firm*—Helfgott & Karas

[57] ABSTRACT

A universal keyboard for hand in which the keys are composed of main keys for natural tones and subkeys for derivative tones, the keys being arranged in the order of musical scale of half tones and in equidistance, the upper operation surfaces of the subkeys being lower than the upper operation surfaces of the adjacent main keys, and further there being provided intervals between the side and upper portions of the adjacent keys respectively. By this arrangement, it becomes easy to play the natural tones and to enable a transposition.

30 Claims, 2 Drawing Sheets

UNIVERSAL KEYBOARD FOR HAND

This is a continuation of application Ser. No. 629,578, filed Dec. 18, 1990, now abandoned.

BACKGROUND OF THE INVENTION

(1) FIELD OF THE INVENTION

The present invention relates to a keyboard operated by hand and used for a piano and an electronic musical instrument.

(2) DESCRIPTION OF THE PRIOR ART

The natural scale is composed of the natural tones C, D, E, F, G, A, and B, and the musical interval is different from each of adjacent tones. Half tone interval is provided between the tones E and F, and between the tones B and C, whole tone interval is provided between remaining tones adjacent to each other. Therefore, it is difficult to realize a keyboard for musical instrument to be operated by hand, in which it is easy to play the natural tones and to achieve an easy transposition.

U.S. Pat. No. 4,782,734 shows a standard keyboard in which the interval between the front white keys (natural tone keys) is different from the interval between the musical intervals, and therefore the transposition becomes difficult.

At the rear portion, the white keys are in a lower position than the rear back keys (derivative tone keys), and therefore the white keys are difficult for playing.

U.S. Pat. No. 4,444,083 shows the keyboard such arrangement that each width of the white keys E, F, B, and C is set to be ¾ as that of the white keys D, G, and A, thereby approaching the distance between the white keys to the musical interval. However, the operation to press the front white key or the rear black key is varied in each transposition, the operation of fingers undesirably becomes irregular thereby making difficult the transposition.

U.S. Pat. No. 4,658,696 shows an embodiment having musical scale arrangement of a pedal keyboard in which each key of natural tones is located at higher position than each of the keys sandwiched between two adjacent natural tone keys to form a valley, and therefore the natural tones are comfortable to play. However, since the natural tones are arranged, in equidistance, by sandwiching the valley, the interval of the natural tone keys do not conform with the interval of musical interval. Therefore, it is difficult to enable the transposition with the same operation of foot.

U.S. Pat. No. 3,392,620 shows an arrangement of keyboard that the front keys and the rear high keys are arranged in the interval of whole tone (two times of half tone), and therefore it is easy to enable the transposition with the same operation of finger, for each whole tone. However, since the natural tones are positioned at the front and the rear positions, it is difficult to detect the natural tones thereby hardly playing them. (It is the same as U.S. Pat. No. 3,468,209 in this point of view.)

U.S. Pat. No. 3,433,881 shows a chromatic keyboard for pedal arranged such that the interval of each key is set to the half tone interval in order to make easy the transposition. However, it is difficult to detect the natural tones thereby hardly playing them.

SUMMARY OF THE INVENTION

The object of the present invention is to present a universal keyboard for hand in which it is easy to detect the natural tone keys thereby making easy its operation, and it is easy to effect a transposition without any necessity of finger movement to the front and rear direction, and with the same operation of finger.

The universal keyboard for hand of the present invention has an arrangement that a plurality of keys is arranged side by side, and wherein each of the keys is arranged in the order of half tones, each of the keys has an operation surface at its upper portion, the operation surfaces are arranged in equidistance side by side, the keys are composed of a plurality of main keys adapted to natural tones and a plurality of subkeys adapted to derivative tones, and the operation surfaces of the subkey are set to be lower than the corresponding operation surfaces of the adjacent main keys.

In addition, the interval between of the operation surfaces is set as 9–15 mm and the interval between the upper side portions of the adjacent opposite to each other keys is set as 2–6 mm.

As mentioned above, since each key is arranged in the order of half tone side by side, and the upper operation surfaces of keys are arranged in equidistance with each other and side by side, the interval between the keys is conformed with the musical interval of the tones adapted to the keys, and therefore the transposition is comfortably enabled without any movement of finger in the front and rear direction and with the same operation of finger. Furthermore, since the operation surfaces of the subkeys are lower than that of the adjacent main keys, the main keys adapted to the natural tones may be easily detected thereby enabling the play of natural tones easily.

In addition, the interval between the operation surfaces is set as below 15 mm, and therefore it is comfortable to simultaneously depress two keys of one octave by using two fingers of one hand; and further the interval is set as above 9 mm, and therefore it is comfortable to depress one key by using one finger. Furthermore, the interval between the upper side portions of the adjacent keys are made as above 2 mm, and therefore it is easily made to press one target key without pressing the adjacent keys by finger; and further the interval of the upper portion is set as below 6 mm, and therefore a sufficient width of the upper operation surface can be provided thereby enabling easy the detection of each key by finger.

DETAILED DESCRIPTION OF THE PREFERRED EMBODIMENTS

Figure 1:
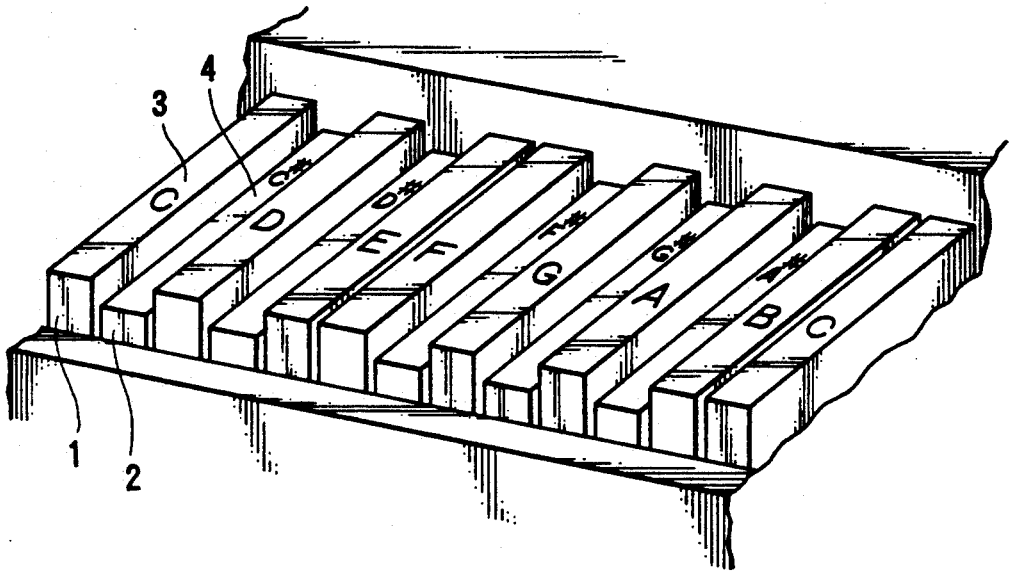
FIG. 1 is a fragmentary perspective view of a first embodiment of the present invention.

FIG. 1 shows a portion of the first embodiment of the present invention, in which above 13 pieces (or above 24 pieces) of bar-like keys 1 and 2 elongated in the front and rear direction are arranged side by side in parallel with each other. The keys 1 and 2 have respective operation surfaces 3 and 4 elongated in the front and rear direction. The width of each of the operation surfaces 3 and 4 is approximately equal to each other and the operation surfaces 3 and 4 are arranged in equidistance and side by side. Assuming that imaginary lines elongated in the front and rear direction and passing on the center of the each width of the operation surfaces 3 and 4, are referred to as center lines; the center lines are arranged in equidistance with each other and the interval therebetween is 9–15 mm (for example 13.5 mm).

Since the interval between the center lines is set as below 15 mm, it is comfortably enable to simultaneously depress two keys of one octave by using two fingers of one hand. Furthermore, since the interval between the center lines is set as above 9 mm, it is suitable to push only one key by one finger tip. Each of the keys 1 and 2 has a common supporting line (not shown) elongated in the traverse direction at the rear portion of the respective operation surfaces, and therefore the keys 1 and 2 may be moved around the supporting line. The stroke of the key is set as the value 20–90% (for example 6.5 mm) of the average interval between the center lines, at the front end point of the key.

In the case where the interval between the center lines is small, it may be possible to easily push only one key by the finger tip by reducing the stroke of the key.

The supporting line may be located at the front of the operating surface of key, and further the entire key may be vertically moved by using a resilient member without using the supporting line. Furthermore, pressing force for key may be electrically detected and it is possible to provide a contact sensor on the operation surface of the key per se which is not moved.

The keys are composed of a plurality of main keys 1 and a plurality of subkeys 2. The main keys 1 are adapted to the natural tones C, D, E, F, G, A, and B and are white; the subkeys 2 are adapted to the derivative tones C#, D#, F#, G#, and A# and are black. These keys are arranged in order of musical scale from left to right C, C#, D, D#, E, F, F#, G, G#, A, A#, B, and C in order. The operation surfaces of the keys are arranged in equidistance and the keys are arranged in the order of musical scale of half tones side by side, and therefore the interval of the keys is conformed with the musical interval adapted to the keys respectively thereby enabling an easy transposition with the same operation of finger and without any finger movement in the front or rear direction.

The operation surface 3 of each main key 1 is approximately in the same level in height, and the operation surfaces 4 of the subkeys 2 are lower than the corresponding operation surfaces 3 of the adjacent main keys 1 respectively. Namely, each portion of the operation surface 4 of the subkeys 2 is lower than the corresponding portion of the operation surfaces 3 of the adjacent main keys respectively, by the value 10–150% of the above-mentioned average interval of the center lines, preferably 15–60% (for example 4.5 mm). Therefore, the main keys 1 adapted to the natural tones are easily detected thereby enabling an easy playing of the natural tones. If the difference in height is excessively small, the operation surface 3 of the main key 1 becomes hardly discriminated, in a detection, from the operation surface of the subkey 2, on the other hand if it is too large, it may be hardly operated to push the operation surface 4 of the subkey 2.

The length of the upper surface of the operation surfaces 3 and 4 is 30–120 (for example 100) mm. The supporting wire for the keys 1 and 2 is positioned at the rear position by 60 mm from the operation surfaces 3 and 4. Alternatively, it may be possible for the present invention to provide an additional operation portion at the front or the rear portion of the operation surfaces 3 and 4. This alternation is included in the scope of the present invention.

Figure 2:
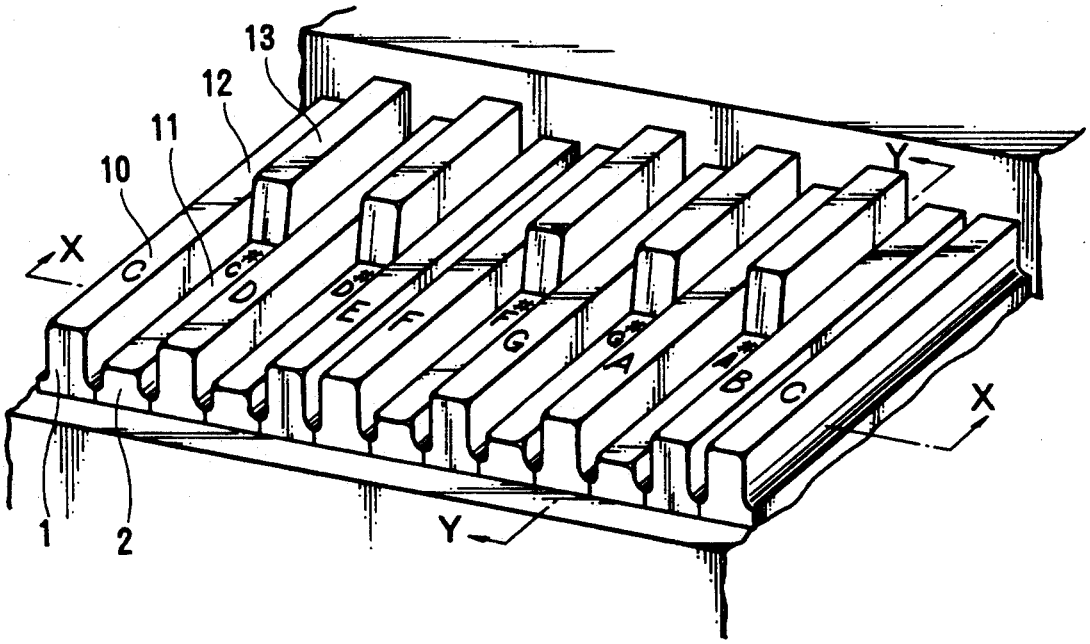
FIG. 2 is a fragmentary perspective view of a second embodiment of the present invention.
Figure 3:
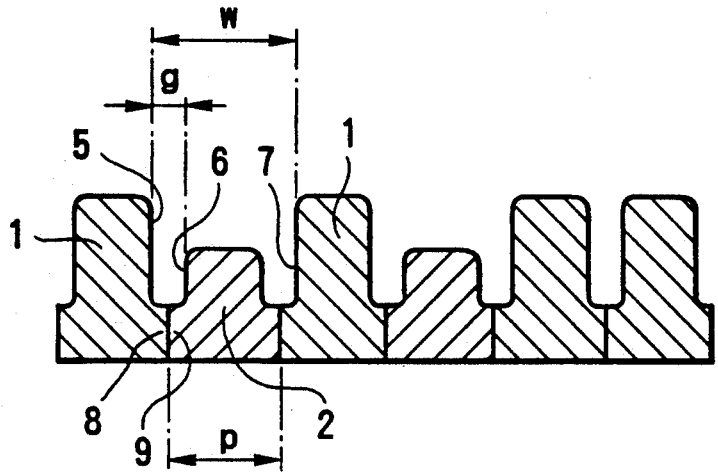
FIG. 3 is a sectional view taken along the line X—X in the second embodiment of the present invention.
Figure 4:
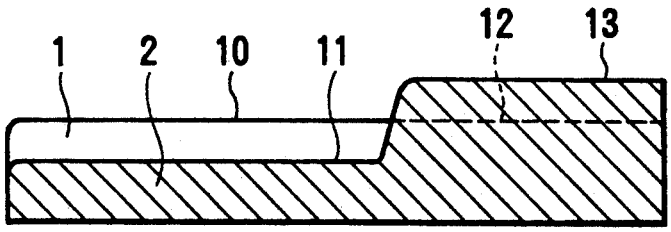
FIG. 4 is a sectional view taken along the line Y—Y in the second embodiment of the present invention.

FIGS. 2 to 4 show a portion of the second embodiment of the present invention, FIG. 3 is a sectional view of the keys 1 and 2 taken along the line X—X in FIG. 2. FIG. 4 is a sectional view showing the relationship between heights of the keys 1 and 2 taken along the line Y—Y in FIG. 2. According to the present embodiment, the interval g between the upper side portions 5 and 6 of the adjacent keys 1 and 2 opposite to each other is 2–6 mm (for example, 4.5 mm). The interval W between the upper side portions 5 and 7 of the two adjacent keys 1 (or 2) opposite to each other is larger than the width p of the key 2 (or 1), and therefore in the case where only one key 2 (or 1) is pressed by finger, the finger can surely press the target key without pressing the adjacent key undesirably even if the finger is somewhat shifted from the center line of the key 2 (or 1). However, if the interval g is below 2 mm, the above-mentioned effect is hardly expected, and if it is larger than 6 mm, the width of the operation surface of the key 2 (or 1) becomes small thereby hardly detecting the key 2 (or 1) by finger.

The lower side portions 8 and 9 of the adjacent keys 1 and 2 opposite to each other are projected from the base portions of the keys respectively, thereby forming covering portions. By such covering portions, any dust can not be penetrated into the lower portions of the keys 1 and 2 thereby preventing the keys from troubles such as a mechanical trouble of key and electrical detection trouble, and it is possible to increase a mechanical rigidity of key. Furthermore, since it is possible to provide a wide width of the key, it may become easy to observe the keys 1 and 2.

The front operation surface 11 of the subkey 2 is lower than the front operation surface 10 of the adjacent main key 1 as similar to the first embodiment. There is provided an auxiliary operation surface 13 at the rear portion of the operation surface 11 of the subkey 2, and an auxiliary operation surface 12 at the rear portion of the operation surface 10 of the main key 1. The auxiliary operation surface 13 of the subkey 2 is higher than the corresponding auxiliary operation surface 12 of the adjacent main key 1, and the auxiliary operation surface 13 of each subkey is approximately in the same level in height. Namely, each portion of the auxiliary operation surface 13 of the subkey 2 is higher than the corresponding portion of the auxiliary operation surface 12 of the adjacent main key 1 by the value 10–120% of the above-mentioned average interval of the center line, preferably 20–60% (for example 4 mm). The auxiliary operation surfaces 12 and 13 of the subkeys and the main keys are used for exchange of a conventional standard keyboard. Namely, it is possible for derivative tones to press the rear higher auxiliary operation surface 13 of the subkey, and it is possible for the natural tones to press the front operation surface 10 or the rear auxiliary operation surface 12 of the main key, and therefore it may possible to enable the same operation of finger as the finger operation learned by the standard keyboard.

The length of the front operation surfaces 10 and 11 is set as 30–120 mm (for example 60 mm). On the other hand, the length of the rear auxiliary operation surfaces 12 and 13 is set as 20–120 mm (for example 60 mm). Alternatively, it may possible for the present invention to provide an additional auxiliary operation portions at the front (direction) of the operation surfaces 10 and 11 or to provide an additional auxiliary operation portions at the rear (direction) of the auxiliary operation surfaces 12 and 13. Furthermore, the supporting wire for keys 1 and 2 is positioned at the rear by 60 mm from the auxiliary operation surfaces 12 and 13. The remaining structure and function of this embodiment is similar to that in the first embodiment.

Alternatively, the following may be possible in the first and second embodiments of the present invention. It is desirable to set the interval between the center lines of the operation surfaces as equidistance with each other, however it may be allowable for a substantial playing of the keyboard to set the interval with a variation within 10% of the average interval of the center line. The operation surfaces 3, 4, 10, 11, 12, and 13 are approximately plane, however it may be allowable even in a slightly curved surface in the front and rear direction and in the left and right direction. The arrangement of tones adapted to the keys may be set such that the left side key has higher tone than that of the right side key or vice versa, and the arrangement is reversed electrically in an electronic musical instrument.

As mentioned above, according to the universal keyboard for hand of the present invention, the keys of natural tones can be easily detected, and the natural tones may be played easily, and further the transposition may be easily effected with the same operation of finger and without any necessity of the finger movement in the front and rear direction. It should be noted that these alternations mentioned above are included in the scope of the prevent invention.

What is claimed is:

1. A universal keyboard for hand, comprising:
(a) a set of elongated keys arranged laterally side by side;
(b) said set including main keys and subkeys;
(c) said main keys and subkeys of the set being positioned in an alternating arrangement with two of said main keys positioned at two opposing ends of the set;
(d) each of said main keys and subkeys having an operation surface at an upper portion thereof;
(e) said operation surfaces being arranged side by side with each other and approximately in equidistance from each other;
(f) the operation surfaces of said subkeys being set to be lower than the corresponding operation surfaces of adjacent main keys;
(g) said operation surfaces of the main keys and said operation surfaces of the subkeys being arranged in an alternating order with the operation surfaces of two of said main keys being positioned at two opposing ends of the set.

2. A universal keyboard for hand according to claim 1, wherein there are provided auxiliary operation surfaces at rear portions of said operation surfaces of said main keys and said subkeys, respectively, and the auxiliary operation surfaces of said subkeys are set to be higher than the corresponding auxiliary operation surfaces of the adjacent main keys.

3. A universal keyboard for hand according to claim 2, wherein an interval between central lines of each two adjacent operation surfaces is set at 9–15 mm, and an interval between adjacent upper side portions of adjacent keys opposite to each other is set at 2–6 mm.

4. A universal keyboard for hand according to claim 3, wherein there is provided a covering portion formed by lower side portions of the adjacent keys, which are opposite to each other and projected toward each other.

5. A universal keyboard for hand according to claim 1, wherein
said main keys are adapted to natural tones of a musical scale;
said subkeys are adapted to derivative tones of said musical scale.

6. A universal keyboard for hand according to claim 5, wherein an interval between central lines of each two adjacent operation surfaces is set at 9–15 mm, and an interval between adjacent upper side portions of adjacent keys opposite to each other is set at 2–6 mm.

7. A universal keyboard for hand according to claim 6, wherein there is provided a covering portion formed by lower side portions of the adjacent keys opposite to each other and projected toward each other.

8. A universal keyboard for hand according to claim 1, wherein an interval between central lines of each two adjacent operation surfaces is set at 9–15 mm, and an interval between adjacent upper side portions of adjacent keys opposite to each other is set at 2–6 mm.

9. A universal keyboard for hand according to claim 8, wherein there is provided a covering portion formed by lower side portions of the adjacent keys opposite to each other and projected toward each other.

10. A universal keyboard for hand, comprising:
(a) a set of twelve elongated keys arranged laterally side by side,
(b) said set having seven main keys M,
(c) said set having five subkeys S,
(d) said twelve keys of the set being arranged in the order of M S M S M M S M S M S M,
(e) each of said keys having an operation surface at an upper portion thereof,
(f) wherein said operation surfaces are arranged approximately in equidistance side by side with each other,
(g) each operation surface of said subkeys being set to be lower than the corresponding operation surface of the adjacent main keys,
(h) said operation surfaces H of the main keys and said operation surfaces L of the subkeys forming a set,
(i) said operation surfaces of the set being arranged in the order of H L H L H H L H L H L H.

11. A universal keyboard for hand according to claim 10, wherein there are provided auxiliary operation surfaces at rear portions of said operation surfaces of said main keys and said subkeys, respectively, and the auxiliary operation surfaces of said subkeys are set to be higher than the corresponding auxiliary operation surfaces of the adjacent main keys.

12. A universal keyboard for hand according to claim 10 wherein a pitch interval of each operation surface is set at 9–15 mm, and an interval between upper side portions of adjacent keys is set at 2–6 mm.

13. A universal keyboard for hand according to claim 12, wherein there is provided a covering portion formed by lower side portions of adjacent keys, each covering portion being opposite and projected toward the abutting adjacent covering portion.

14. A universal keyboard for hand according to claim 10, wherein
said seven main keys are adapted to natural tones of C D E F G A B,
said five subkeys are adapted to derivative tones of C# D# F# G# A#.

15. A universal keyboard for hand according to claim 14, wherein a pitch interval of each operation surface is set at 9–15 mm, and the interval between upper side portions of a key and an opposite upper side portion of adjacent keys is set at 2–6 mm.

16. A universal keyboard for hand according to claim 15, and wherein there is provided a covering portion formed by a lower side portion of adjacent keys each said covering portion being opposite and projected toward another said covering portion.

17. A universal keyboard for hand according to claim 11, wherein a pitch interval of each of the operation surfaces is set at 9–15 mm, and the interval between upper side portions of adjacent keys is set at 2–6 mm.

18. A universal keyboard for hand according to claim 17, having a covering portion formed by a lower side portion of adjacent keys, each covering portion being opposite and projected toward an abutting adjacent covering portion.

19. A universal keyboard for hand, comprising:

(a) a first set of five elongated keys comprising 3 main keys and 2 sub-keys arranged laterally side by side;

(b) a second set of seven elongated keys comprising 4 main keys and 3 sub-keys;

(c) said first set and second set of keys being laterally adjacent each other;

(d) said main keys and sub-keys of said first set being positioned in an alternating arrangement so that the lateral end of said first set is the main key;

(e) said main keys and sub-keys of said second set being positioned in an alternating arrangement so that the lateral end of said second set is the main key;

(f) each of said main keys and subkeys having an operation surface at an upper portion thereof;

(g) each said operation surface being arranged approximately in equidistance side by side from another;

(h) each operation surface of each said sub-key being set to be lower than the corresponding operation surfaces of said adjacent main keys;

(i) operation surfaces of the keys of said first set comprising a first set of operation surfaces;

(j) operation surfaces of the keys of said second set comprising a second set of operation surfaces;

(k) said operation surfaces of said main keys of said first set and said operation surfaces of said sub-keys of said first set being arranged in an alternating order, so that the lateral end of said first set is the operational surface of said main keys;

(l) said operation surfaces of said main keys of said second set and said operation surfaces of said sub-keys of said second set being arranged in an alternating order, so that the lateral end of said second set is the operational surface of said main keys.

20. A universal keyboard for hand according to claim 19, wherein a pitch interval of each of the operation surfaces is set at 9–15 mm, and the interval between upper side portions of adjacent keys is set at 2–6 mm.

21. A universal keyboard for hand according to claim 20, wherein there is provided a covering portion formed by a lower side portion of adjacent keys, each covering portion being opposite and projected toward an abutting adjacent covering portion.

22. A universal keyboard for hand according to claim 19, wherein auxiliary operation surfaces are provided at the rear portions of said operation surfaces of said main keys and said sub-keys respectively, and the auxiliary operation surfaces of said sub-keys are set to be higher than the corresponding auxiliary operation surfaces of said adjacent main keys.

23. A universal keyboard for hand according to claim 19, wherein said main keys and subkeys are arranged laterally side by side and are adapted to tones of general half tone scale, in an order of the general half tone scale.

24. A universal keyboard for hand according to claim 20, wherein said main keys and subkeys are arranged laterally side by side and are adapted to tones of general half tone scale, in an order of the general half tone scale.

25. A universal keyboard for hand according to claim 21, wherein said main keys and subkeys are arranged laterally side by side and are adapted to tones of general half tone scale, in an order of the general half tone scale.

26. A method of assigning tones to universal keyboard for hand according to claim 19, comprising:

the step of assigning a tone of general half tone scale to the keys arranged laterally side by side, in an order of the half tone scale.

27. A universal keyboard for hand according to claim 22, wherein a pitch interval of each of the operation surfaces is set at 9–15 mm, and the interval between upper side portions of adjacent keys is set at 2–6 mm.

28. A universal keyboard for hand according to claim 27, having a covering portion formed by a lower side portion of adjacent keys, each covering portion being opposite and projected toward an abutting adjacent covering portion.

29. A universal keyboard for hand according to claim 22, wherein said main keys and subkeys are arranged laterally side by side and are adapted to tones of general half tone scale, in an order of the general half tone scale.

30. A universal keyboard for hand according to claim 27, wherein said main keys and subkeys are arranged laterally side by side and are adapted to tones of general half tone scale, in an order of the general half tone scale.

* * * * *